United States Patent [19]

Reeves et al.

[11] Patent Number: 5,005,634

[45] **Date of Patent: * Apr. 9, 1991**

[54] BI-DIRECTIONAL FLEXIBLE SEAL

[76] Inventors: Richard L. Reeves, 24265 Gradera Rd., Homeland, Calif. 92348; Dennis Woodland, 19760 Temescal Canyon Rd., Corona, Calif. 91719

[ * ] Notice: The portion of the term of this patent subsequent to Jul. 10, 2007 has been disclaimed.

[21] Appl. No.: 448,936

[22] Filed: Dec. 12, 1989

Related U.S. Application Data

[63] Continuation of Ser. No. 382,848, Jul. 20, 1989, Pat. No. 4,940,080.

[51] Int. Cl.[5] ..... F28D 19/00

[52] U.S. Cl. ..... 165/9; 277/815

[58] Field of Search ..... 165/9; 277/815

[56] References Cited

U.S. PATENT DOCUMENTS

| | | | |
|---|---|---|---|
| 1,746,598 | 2/1930 | Ljungstrom | 165/9 |
| 2,517,512 | 8/1950 | Tigges . | |
| 2,549,583 | 4/1951 | Eckersley | 165/9 |
| 3,011,766 | 12/1961 | Hess | 165/9 |
| 3,545,532 | 12/1970 | Waitkus | 165/9 |
| 3,954,135 | 5/1976 | Hewlitt . | |
| 4,088,146 | 5/1978 | Hagar . | |
| 4,098,323 | 7/1978 | Wiegard et al. . | |
| 4,593,750 | 6/1986 | Finnemore | 165/9 |
| 4,673,026 | 6/1987 | Hagar et al. | 165/9 |

*Primary Examiner*—Albert W. Davis, Jr.
*Attorney, Agent, or Firm*—Lyon & Lyon

[57] ABSTRACT

A flexible radial bi-directional seal for sealing a diaphragm against a sector plate in a rotating drum-type air preheater includes a baseplate assembly having a pair of rigid baseplates. Each baseplate has a planer section and a flange, with the baseplates joined together and the flanges generally curving away from each other and forming a longitudinal slot therebetween. A replaceable pack assembly includes a pack of parallel planer leaves separated by spacers. The replaceable pack is removably attached to the baseplate assembly with engagement edges of the leaves of the replaceable pack engaging the longitudinal slot.

6 Claims, 3 Drawing Sheets

BI-DIRECTIONAL FLEXIBLE SEAL

This is a continuation of co-pending application Ser. No. 382,848 filed on July 20, 1989 now U.S. Pat. No. 4,940,080 granted July 10, 1990.

BACKGROUND OF THE INVENTION

Field of the Invention

The field of the present invention is flexible seals. More particularly, the invention relates to a bi-directional flexible seal for use in drum type heat exchangers.

In large-scale power generating facilities, it is generally desirable to pre-heat the air provided for combustion, to improve the thermodynamic efficiency of the power generation and to reduce fuel consumption. One type of air preheater (the Ljungstrom type) includes a rotating drum having heat exchange surfaces or plates attached to and continuously rotating with the drum. As the drum rotates, the heat exchange plates move from a combustion air flow side to an exhaust ga flow side and then back to the combustion air flow side. In this manner, the heat exchange plates of the drum continuously transfer heat from the hot exhaust gases passing over the plates to the combustion air, thereby raising the temperature of the combustion air and improving efficiency.

In order to prevent mixing o f the exhaust gases with the combustion air during the heat exchange process, a sector plate is provided on each flat or radial side of the drum and a circumferential ring surrounds the cylindrical outside of the drum within the air preheater housing. The drum has diaphragms projecting radially outward to the ring from the drum driveshaft. As each diaphragm passes from the combustion air section to the exhaust gas section of the air preheater, the diaphragm is sealed against the sector plate to prevent mixing of the exhaust and combustion air flows. Circumferential seals and shaft seals are generally also provided.

Various radial seals for intermittently sealing the diaphragms as they pass between the sector plates have been known in the past. These known seals have met with varying degrees of success. In practice, it has often proven difficult to obtain consistent performance from radial seals. One major difficulty encountered is the dimensional variations within the drum and preheater caused by temperature variations. Although the seals are necessarily installed in the preheater when it is off-line and at room temperature, once in operation, localized drum temperatures rise significantly. Since the drum is large (typically from 12 to 36 feet in diameter), the coefficient of thermal expansion of the preferred construction metals can produce considerable dimensional shifts or distortion resulting in inadequate sealing between the diaphragms and the sector plates.

In addition, the repeated intermittent sealing engagement of the sealing surfaces against the sector plates results in a wearing down of the surfaces which can also lead to decreased sealing efficiency. Wear problems can become especially severe if the sealing surfaces are engaged too closely to the sector plate (overengagement). This condition resulting from improper alignment of the seals also creates excessive seal stresses which can lead to early seal failure.

Drum type air preheaters may be oriented with the axis of rotation of the drum being either vertical (i.e. in a "carousel" orientation) or horizontal (i.e. a ferris wheel orientation) with the horizontal access ("ferris wheel" orientation). Due in part to the usual imbalance in the drum, when the air preheater is shut down and the drive motor disengaged, the drum may rotate forward (i.e. in its driven direction) or backward by a small amount. This continued "free wheeling" rotation in a forward direction is ordinarily acceptable. However, if the wheel rotates backwards or in the reverse direction, certain seals may be damaged since they are designed and intended to engage the sector plates only when moving in the forward direction.

SUMMARY OF THE INVENTION

Accordingly, it is an object of the invention to provide a flexible, radial seal for an air preheater which is durable and provides for effective sealing between the air preheater diaphragms and the sector plate.

It is another object of the invention to provide such a seal which is bi-directional and which forms an efficient seal with either direction of rotation of the air preheater drum.

It is yet another object of the invention to provide an air pre-heater seal which has a replacable pack of leaves to facilitate quick and economical replacement of worn seal surfaces.

It is still a further object of the invention to provide an air pre-heater seal having spaced apart leaves which allow for the creation of turbulence between the leaves to improve seal efficiency.

It is yet another object of the invention to provide an air pre-heater seal having flanges which prevent over stressing of the seal leaves.

To this end, a flexible radial bi-directional seal for an air pre-heater includes a first base plate joined to a second base plate and a plurality of flexible spaced-apart leaves mounted at least partially inbetween the first and second base plates. Preferably, the base plates each have a planer section and a curved flange, with the planer sections of the base plates joined together. Most desirably, a replacable pack assembly is removably attached to the base plate assembly, and is disposed at least partially in between the base plates. Preferably, the replaceable pack assembly includes a plurality of flexible spaced apart leaves for sealingly engaging a sector plate. Spacers may be disposed in between the leaves.

In a preferred embodiment, the base plates have a generally S-shaped curve and the flanges of the base plates form a slot between each other for receiving a replacable pack. Slotted mounting holes are provided in the base plates for fastening the seal to a diaphragm of an air preheater. The first and second base plates may be identical. The replacable pack preferably has from two to five spaced apart leaves.

Other objects and features of the present invention will become apparent from the detailed description taken in connection with the accompanying drawings which disclose one embodiment of the invention. It is to be understood, however, that the drawings are designed for the purpose of illustration only and are not intended as a definition of the limits of the invention.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
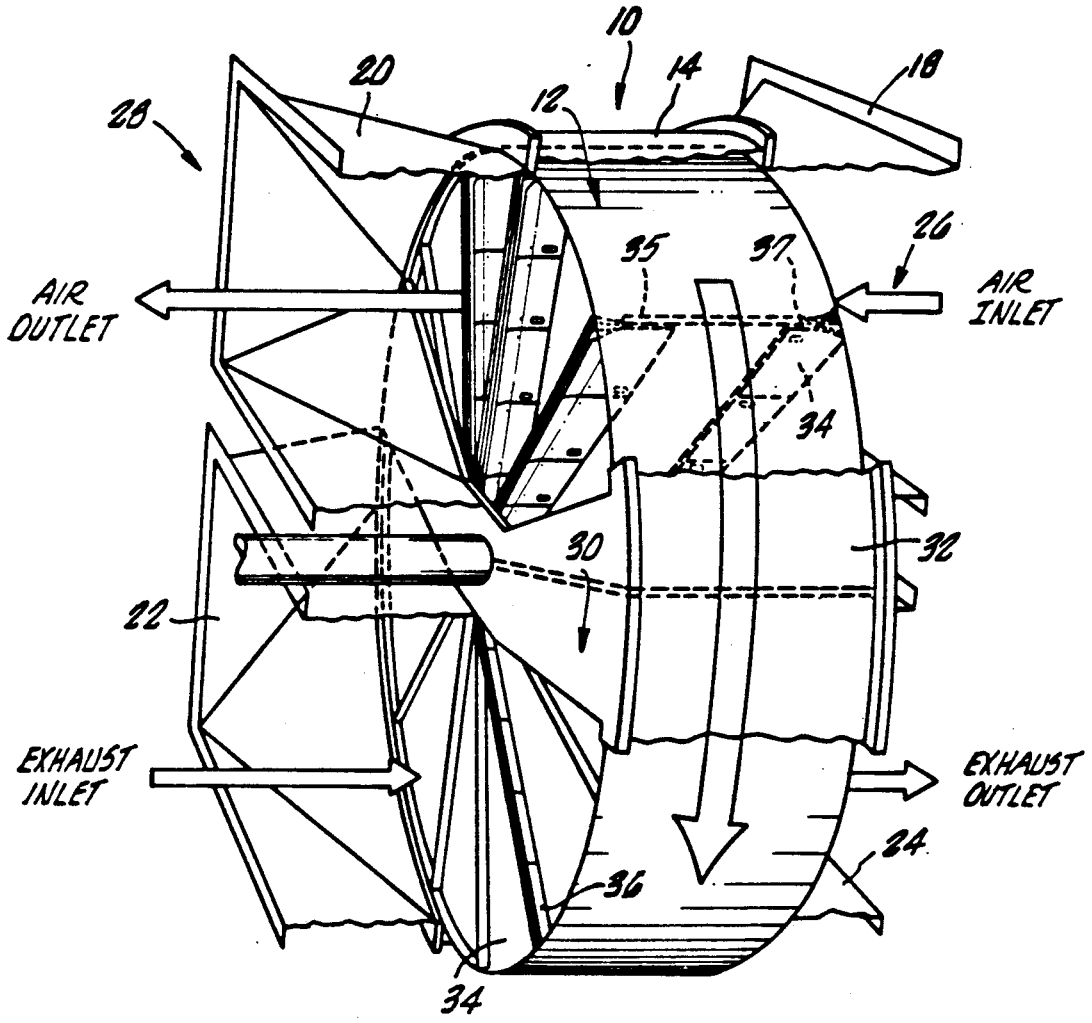
FIG. 1 is a perspective view of an air preheater drum having the radial bi-directional flexible seals of the present invention.

Referring now in detail to the appended drawings, as shown in FIG. 1, an air preheater 10 includes a drum assembly 12 rotatably mounted within a housing 14. The drum assembly 12 rotates on a horizontally oriented shaft 16 which is attached at its other end to a drive means (not shown). An air inlet duct 18 for combustion air is attached to the cold side 26 of the air preheater. Correspondingly, an air outlet duct 28 leads from the hot side 28 of the air preheater.

In a similar manner, opposite to the air inlet duct 18 and the air outlet duct 20 is an exhaust gas inlet duct 22 leading to the hot side 28 of the air preheater 10 and an exhaust gas outlet duct 24 similarly joined to the cold side 26 of the drum assembly 12. A sector plate 30 extends across the drum assembly 12 to provide a sealing surface for isolation of the air flow and exhaust flow at the ends or flat radial surfaces of the drum assembly 12. The sector plate is relatively narrow and is dimensioned to span a sector of the drum circumference sufficient to have one diaphragm on each side (hot and cold) engage the sector plate. A housing ring 32 circumscribes the drum assembly 12 to provide a circumferential sealing surface.

Within the drum assembly 12 are a plurality of radially oriented diaphragms. Radial seal sections or seals 36 are provided at the hot and cold side radial edges 35 and 37 of the diaphragms 34. The radial seal sections 36 are typically 47¾ and 38¾ inches long. The number of radial seal sections 36 mounted on each diaphragm 34 varies with the length the diaphragm or the diameter of the drum assembly 12. The diameter of the drum assembly 12 typically ranges between 12 feet and 36 feet such that each diaphragm includes several radial seal sections 36. The radial seal sections 36 are bolted to the diaphragms 34 and are positioned essentially line to line against each other to provide a continuous sealing surface at each diaphragm edge 35 and 37. The seal sections and installations on the hot and cold side diaphragm edges are typically identical.

Figure 5:
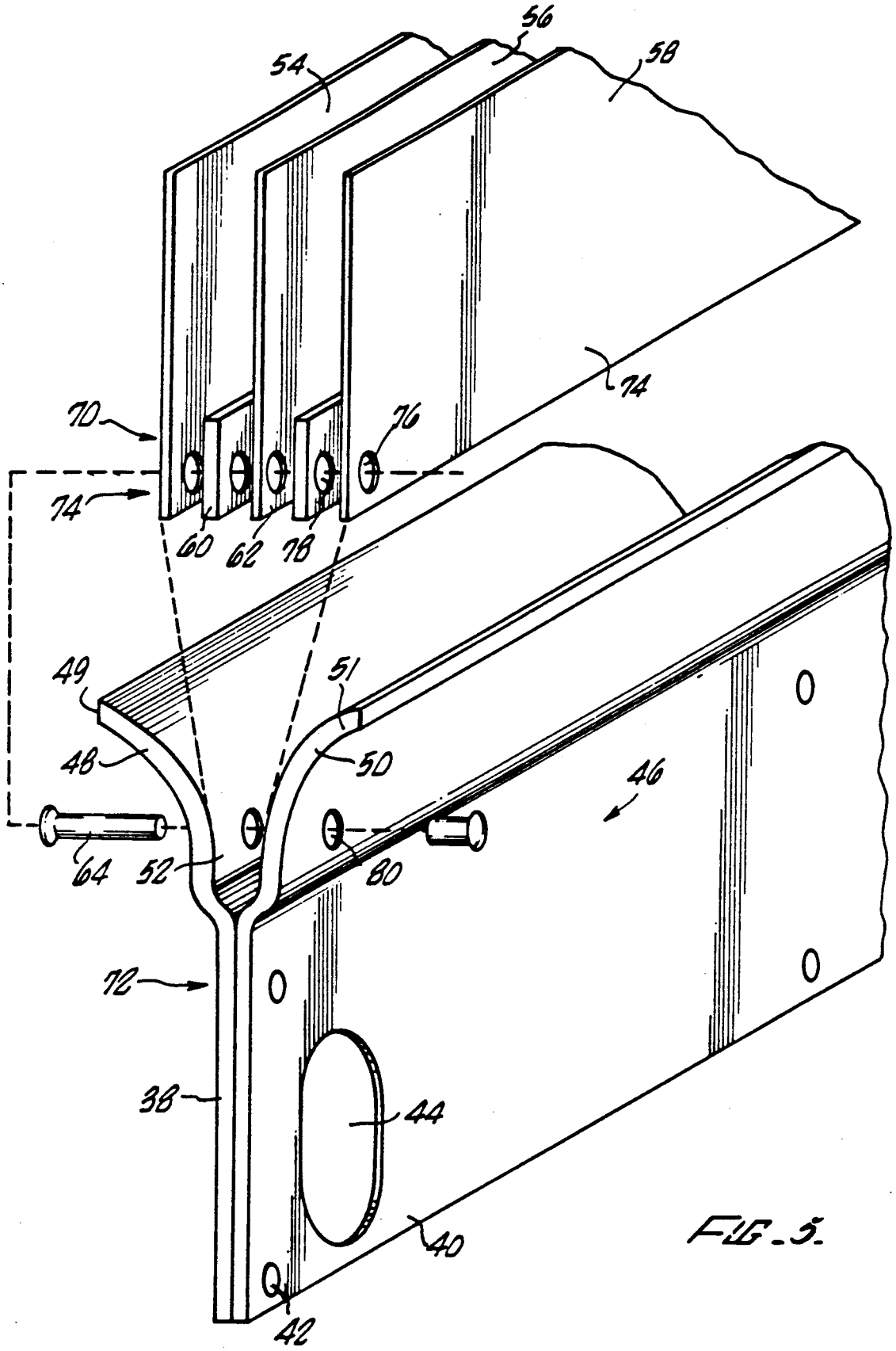
FIG. 5 is an enlarged fractional perspective partially exploded view of the preferred embodiment of the seal of the invention illustrating the replaceable pack.

Referring to FIG. 5, a radial seal section 36 includes first and second baseplates 38 and 40 preferably made of approximately 0.06 inch stainless steel. The baseplates 38 and 40 each have a planer section 46. The planer sections 46 of the baseplates 38 and 40 are joined together by rivets 42 and spot welds. An elongated slotted mounting hole 44 is provided at approximately every 9 inches along the length of the radial seal section 36. The base plates 38 and 40 include flanges 48 and 50 which are generally S-shaped as shown in FIG. 5. The flanges 48 and 50 form a longitudinal slot 52 extending along the length of the top of the radial seal section 36.

The seal section 36 includes a replaceable pack 70 having leaves 54, 56, and 58 preferably of a nickel alloy such as inconel, monel, or 430 stainless steel. The leaves are relatively thin (0.005 to 0.023 inches thick) in comparison to the baseplates 38 and 40 and are of equal width. The leaves 54, 56 and 58 are spaced apart by spacers 60, 62 which may be from 0.005 to 0.125 inches thick.

The replaceable pack 70 is fitted into the slot 52 inbetween the flanges 48 and 50 of the base plate assembly 72. Aligned holes 76 in the leaves 54, 56, and 58, and holes 78 in the spacers 60 and 62 also align with holes 80 in the flanges of the baseplate assembly 72. The replaceable pack 70 is positioned in the slot 52 and is securely attached to the baseplate assembly 72 by rivets 64 or bolts passing through the aligned holes. Engagement sides or edges 74 of the leaves engage the flanges 48 and 50 on either side of the slot 52.

In operation, combustion feed air is blown or drawn through the air inlet duct, through the interstitial spaces inbetween the diaphragms 34 of the drum assemble 12, and then out to the air outlet duct 20 and on to the combustion chamber of the boiler. Analogously, hot exhaust gases from the combustion chamber or boiler flow to the exhaust inlet duct 22, through the drum assembly 12, then to the exhaust outlet duct 24. The drum assembly 12 rotates at approximately 1 to 4 rpm (depending on the drum size). As the exhaust gases pass through the drum assembly 12 the surfaces therein are heated. In a continuous manner, the heated surfaces then pass to the air flow side of the drum where heat is transfered from the surfaces of the drum assembly 12 to the air, thereby heating the air for improved boiler efficiency.

The exhaust gases and air flowing through the drum assembly 12 in opposite directions must, of course, be isolated from each other. On the radial sides of the drum, this is accomplished with the radial seal sections or seals 36 intermittently engaging the sector plate 30 as the drum assembly rotates.

Figure 2:
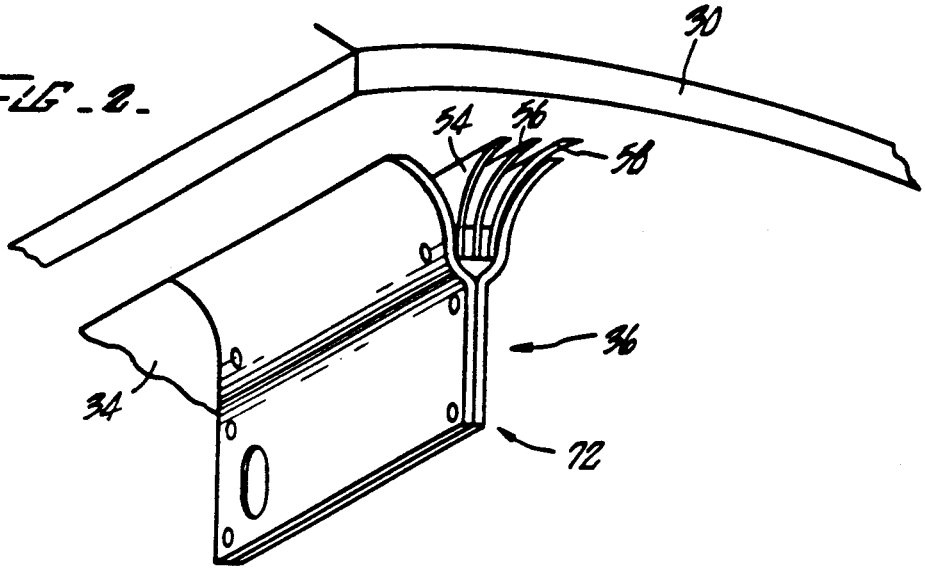
FIG. 2 is an enlarged fractional perspective view of the seal of the invention engaging and sealing against a sector plate.

As shown in FIG. 2, as the seal of the invention engages the sector plate 30, the leaves are flexed somewhat in a direction opposite to the direction of rotation of the drum assembly 12. The upper surfaces of the leaves 54, 56 and 58 engage the sector plate 30, with the flanges 48 of the base plate assembly 72 remaining spaced apart from the sector plate 30. Circumferential seals (not shown) provide seals between longitudinal edges of the diaphragms 34 and the housing ring 32.

Figure 3:
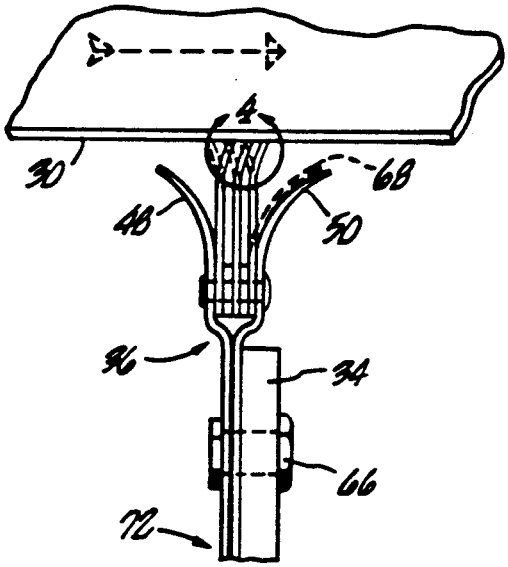
FIG. 3 is an end view of the seal of the invention fastened to a diaphragm of an air preheater drum with the leaves of the seal engaging a sector plate.

Referring to FIG. 3, the baseplate assembly 72 is bolted to the diaphragm 34 with the flanges 48 and 50 positioned immediately above the radial edges 35 and 37 of the diaphragm. The leaves 54, 56 and 58 in the relaxed state, extend parallel to the plane of the baseplate assembly 72 specifically to the plane of the planar section 46 thereof. The leaves 54, 56 and 58 are dimensioned such that in the relaxed or unengaged condition they extend beyond the upper edges 49, 51 of the flanges 48 and 50 by approximately 0.25 to 1.5 inches. FIG. 3 illustrates the normal amount deflection of the leaves 54, 56 and 58 as they engage the sector plate 30. Significantly, the angle between the leaves and the sector plate is set by the amount of engagement.

The alternate position 68 in FIG. 3 illustrates the maximum amount of leaf deflection, a condition which would occur only at severe over engagement due to misalignment within the drum assembly. As shown in phantom in FIG. 3, when the direction of rotation of the drum is reversed, i.e., when the drum rotates backward, e.g., at shutdown of the air preheater, the curvature of the leaves is reversed. In switching from the position shown in solid line to the position shown in phantom, in FIG. 3, the leaves 54, 56 and 58 must momentarily pass through a distorted double curvature or S shaped position. However, passing through this transition does not damage the leaves due to their flexibility and bi-directional design.

Figure 4:
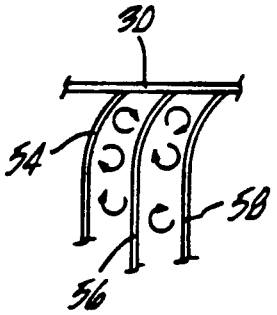
FIG. 4 is an enlarged schematic view of the leave tips of the seal engaging a sector plate.

As shown in FIG. 4, the spaces between the leaves 54, 56 and 58 as they engage the sector plate 30 allow for the creation of turbulence in the air or exhaust gas momentarily disposed in between the leaves. This turbulence is believed to increase the efficiency of the seal in contrast to having the leaves adjoining or overlying each other.

Thus, while only one embodiment of the present invention as been shown and described, it will be obvious that many changes and modifications may be made thereunto, without departing from the spirit and scope of the invention.

What is claimed is:

1. An air preheater having a flexible radial seal comprising:

a first base plate;

a second base plate attachable to said first base plate, said first and second base plates each have a planer section and a curved flange; and at least one flexible leaf attachable at least partially in between and extending outwardly from said first and second base plates.

2. The air preheater of claim 1 further comprising fasteners passing through said first and second base plates and said at least one leaf.

3. An air preheater comprising:

a rotatable drum having a plurality of diaphragms;

a plurality of flexible radial seals attached to said diaphragms, each said flexible radial seal comprising a first base plate and a second base plate joined to said first base plate, said first and second base plates each having a planer section and a curved flange with at least one flexible leaf secured in between and extending outwardly from said first and second base plates;

a sector plate extending alongside either side of said drum, with said flexible radial seals flexibly engageable against said second plate.

4. The air preheater of claim 3 further comprising means for adjusting the engagement between the flexible radial seals and the sector plate.

5. The air preheater of claim 3 wherein said planer section of said first and second base plates have a slotted opening for attachment to a planer diaphragm edge with a fastener.

6. A flexible radial seal for an air preheater comprising:

a first base plate;

a second base plate attachable to said first base plate, said first and second base plates each having a planer section and a curved flange; and at least one flexible leaf attachable at least partially in between and extending outwardly from said first and second base plates.

* * * * *